US012618345B1

(12) United States Patent
Serpe

(10) Patent No.: US 12,618,345 B1
(45) Date of Patent: May 5, 2026

(54) TIMING ADJUSTER

(71) Applicant: John J. Serpe, Berwyn, IL (US)

(72) Inventor: John J. Serpe, Berwyn, IL (US)

( * ) Notice: Subject to any disclaimer, the term of this patent is extended or adjusted under 35 U.S.C. 154(b) by 0 days.

(21) Appl. No.: 19/305,059

(22) Filed: Aug. 20, 2025

(51) Int. Cl.
*F01L 1/344* (2006.01)
*F01L 1/02* (2006.01)

(52) U.S. Cl.
CPC ..... *F01L 1/344* (2013.01); *F01L 1/026* (2013.01); *F01L 2250/06* (2013.01)

(58) Field of Classification Search
CPC ..... F01L 1/344; F01L 1/026
See application file for complete search history.

(56) References Cited

FOREIGN PATENT DOCUMENTS

GB 2180597 A * 4/1987 ..... F01L 13/0047
WO WO-9416203 A1 * 7/1994 ..... F01L 13/0047

* cited by examiner

*Primary Examiner* — Ngoc T Nguyen
(74) *Attorney, Agent, or Firm* — Pauley Erickson & Swanson

(57) ABSTRACT

A timing adjuster device and a method for operating the timing adjuster. The timing adjuster includes a driver and an anchor fixed with respect to a frame. The timing adjuster can include four gears, three links, four shafts and a driver. The driver can drive at least one of the gears to move a timing member of an engine.

20 Claims, 11 Drawing Sheets

TIMING ADJUSTER

BACKGROUND OF THE INVENTION

Field of the Invention

This invention relates to a timing adjuster device, such as a dynamic timing adjuster that can be used to dynamically change the timing and/or phasing of an engine, and a method for operating the timing adjuster device.

Discussion of Related Art

Variable valve timing (VVT) is existing and known technology that is used to adjust the openings and closings of the valves of an engine, for example, as a function of or based upon the operating conditions of the engine. VVT can be used, for example, to improve the performance, the fuel economy and/or the undesirable emissions of the engine.

In some conventional and known VVT systems, the timing of the valves of the engine are adjusted to suit the speed and/or a load of the engine. For example, some conventional and known VVT systems can be used to advance or retard the valve events based upon a direction of a piston in the engine. Other conventional and known VVT systems employ interpolated virtual angles on a flywheel.

Existing VVT systems can be used to improve the performance and/or the fuel economy of the engine, reduce undesirable emissions, and/or increase the torque and/or smoothness of the engine. For example, VVT systems are conventionally used with mechanical devices, electro-hydraulic systems and/or camless systems to achieve desired results.

Some relatively early and known VVT systems use a variator to change a phase of a camshaft and the corresponding valves of the engine. Other later known VVT systems use a helical camshaft and/or movable fulcrum systems. Some known VVT systems are used in automotive engines, particularly in view of increasingly strict emissions regulations, for example, for automotive engines.

It is apparent that there is a need to enhance the capabilities and applications for conventional and known VVT systems.

SUMMARY OF THE INVENTION

It is one object of this invention to provide a device that has a controlled timing offset between two rotating shafts of an engine, for example. There are no size restrictions thus making the device of this invention fully scalable upwards and/or downwards.

According to some embodiments of this invention, the device is made up of or includes two shafts and four gears that are all held in place by three links, for example, all positioned on or in a same plane. In some embodiments of this invention, the links hold the gears constantly engaged and maintain a geometry of physical relationships between the elements. In other embodiments of this invention, the two shafts are not required to have any lateral or axial movement and/or need only to rotate.

According to some embodiments of this invention, each shaft also has one gear and one end of a link. In some embodiments of this invention, the other ends of the links extending from the shafts connect to additional shafts on a center link. In some embodiments of this invention, the middle of the three links, sometimes called the center link, has a gear mounted at each end. In other embodiments of this invention, each center link gear engages the gear on the shaft adjacent to it.

In some embodiments of this invention, the sums of the pitch diameters of the two gears on the center link are greater than a distance between the pitch diameters of the gears on the shafts. According to some embodiments of this invention, this formula for pitch diameters dictate that the links and gears assume a non-linear position remaining on the same plane. In some embodiments of this invention, when the gears assume different positions the center link must move and moving the center link will move the gears, and as this movement occurs the timing of the gears on the shafts can vary. In some embodiments of this invention, because the gears and shafts are mechanically linked, the timing can vary as the timing of the gears on the shafts varies.

In some embodiments of this invention, the nature of this geometric configuration will dictate or require a non-linear variation of a timing change with respect to a center link position. In other embodiments of this invention, different link positions can provide different levels of timing adjustments.

According to some embodiments of this invention, as the device moves through different link positions, it will provide different levels of timing adjustments. In some embodiments of this invention, the device of this invention has a 3 link timing adjustment device which can provide different technical features that take advantage of the geometry described.

In some embodiments of this invention, as the links move through all possible positions, a path is or can be established and the timing, also known as phasing, between the shafts will change at different rates along this path. According to some embodiments of this invention, by restricting the link positions about an area where this rate is high will produce a relatively large amount of timing (phase) adjustment.

In some embodiments of this invention, anchoring the links at any point along this path will force the timing between the shafts to remain unchanged and/or locked in and will make the entire assembly rigid. In other embodiments of this invention, changing the position of where the links are anchored will or can force the shafts to change their timing (phase). According to some embodiments of this invention, these changes are made dynamically which will result in dynamically changing the timing.

According to some embodiments of this invention, when the anchorage is moved dynamically along the path, the 3 link timing adjustment device of this invention can be used to dynamically change the timing between the shafts.

In some embodiments of this invention, the device is relatively simple. According to some embodiments, a driving gear and a driven gear have positions that are totally constrained. Between these two constrained gears there are at least two other gears which are not constrained. In some embodiments of this invention, all of the gears in the system are connected in a series arrangement with three independent but not anchored or constrained links. In some embodiments of this invention, the links maintain the spacing between all gears so that the gears are always properly engaged and restrict gear movement to within a single plane.

According to some embodiments of this invention, the pitch diameters of all gears are such that a straight line cannot be formed with the connecting links. In some embodiments of this invention, in a constant operation, the three links adjust their position according to the direction of the torque. According to some embodiments of this invention, the gears transmit information immediately.

According to some embodiments of this invention, if the driving gear is reversed, the links rearrange their geometry rather than immediately transmit rotational information to the driven gear. In some embodiments of this invention, if the geometry of any internal link is constrained, the other two links will be immediately constrained. Thus, as a result the entire device becomes rigid.

According to some embodiments of this invention, any rotational information is directly transmitted between the driving gear and the driven gear, regardless of direction. In some embodiments of this invention, extending any one of the links well beyond its associated gears forms a lever. In some embodiments of this invention, by constraining this one lever, all links can be geometrically locked and rotational information will be transmitted without disruption. In some embodiments of this invention, if this lever is moved, then all three links change their geometry. According to some embodiments of this invention, this forms an offset in the rotational information. In some embodiments of this invention, controlling the position of this lever controls the timing offset.

BRIEF DESCRIPTION OF THE DRAWINGS

This invention is explained in greater detail below in view of exemplary embodiments shown in the drawings, wherein.

DETAILED DESCRIPTION OF THE INVENTION

According to some embodiments of this invention, as device 20, such as an internal reciprocating engine, changes speed, the timing of the engine valves should be changed accordingly. Conventional technology sets the timing between multiple shafts in device 20 and/or the engine which forces the designer or engineer to select a single rotating speed, such as measured in rotations per minute (RPM), for the engine to have one point where it can work at an optimal and/or peak efficiency. In some embodiments of this invention, device 20 is any suitable mechanical, electromechanical and/or electrical apparatus that can operate and/or accommodate timing member 62, such as shown in FIGS. 8, 9 and 11, a timing adjuster, such as a variable timing adjuster and/or any other suitable timing device that can be used to alter and/or change the timing and/or phase of any suitable engine, for example.

Figure 8:
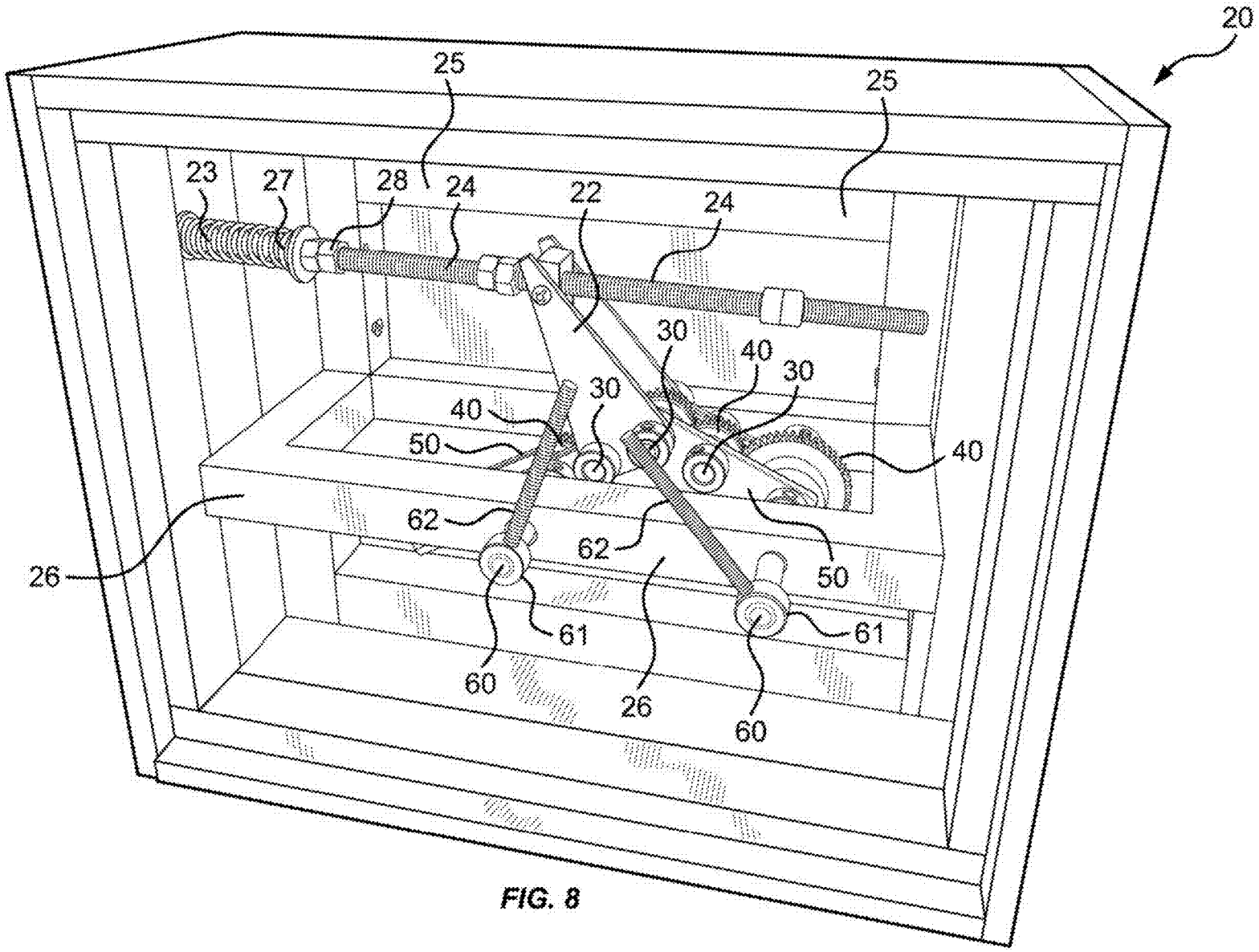
FIG. 8 is a perspective view of 2 drivers, a lever, 2 anchors, 4 gears, 3 links and 4 shafts, and 2 timing members in a first position, according to one embodiment of this invention.
Figure 9:
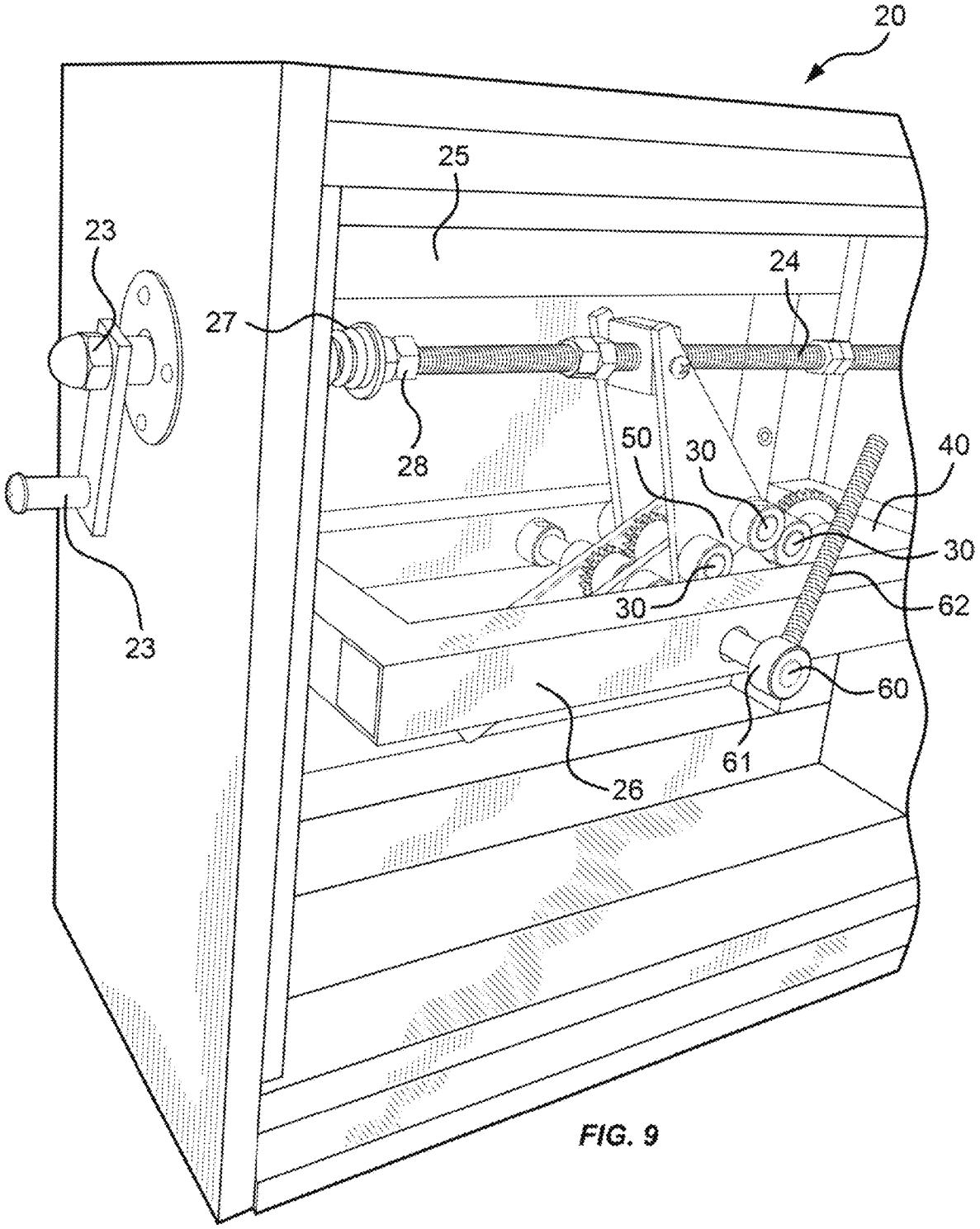
FIG. 9 is a perspective view of 2 drivers, a lever, 2 anchors, 4 gears, 3 links and 4 shafts, according to one embodiment of this invention.
Figure 10:
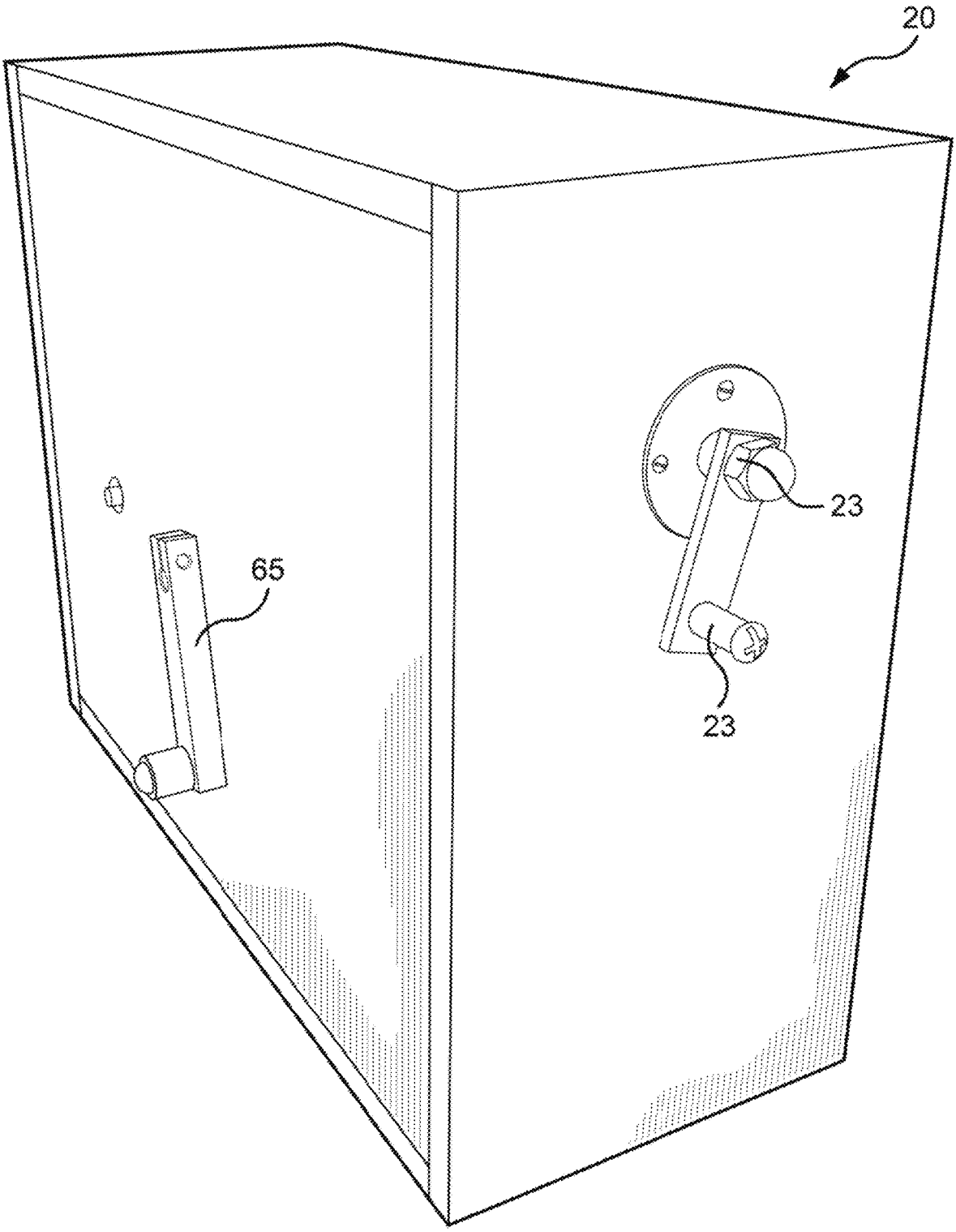
FIG. 10 is a perspective view of 2 drivers, a lever, 2 anchors, 4 gears, 3 links and 4 shafts, according to one embodiment of this invention.

As shown in FIGS. 8-11, for example, according to some embodiments of this invention, device 20 comprises at least one timing member 62 fixed, secured and/or otherwise attached to and/or with respect to rotating shaft 60. In some embodiments of this invention, such as shown in FIG. 8, timing member 62 is removably attached to and/or with respect to rotating shaft 60 by having collar 61 fixed, secured and/or otherwise attached to rotating shaft 60 and timing member 62.

Figure 11:
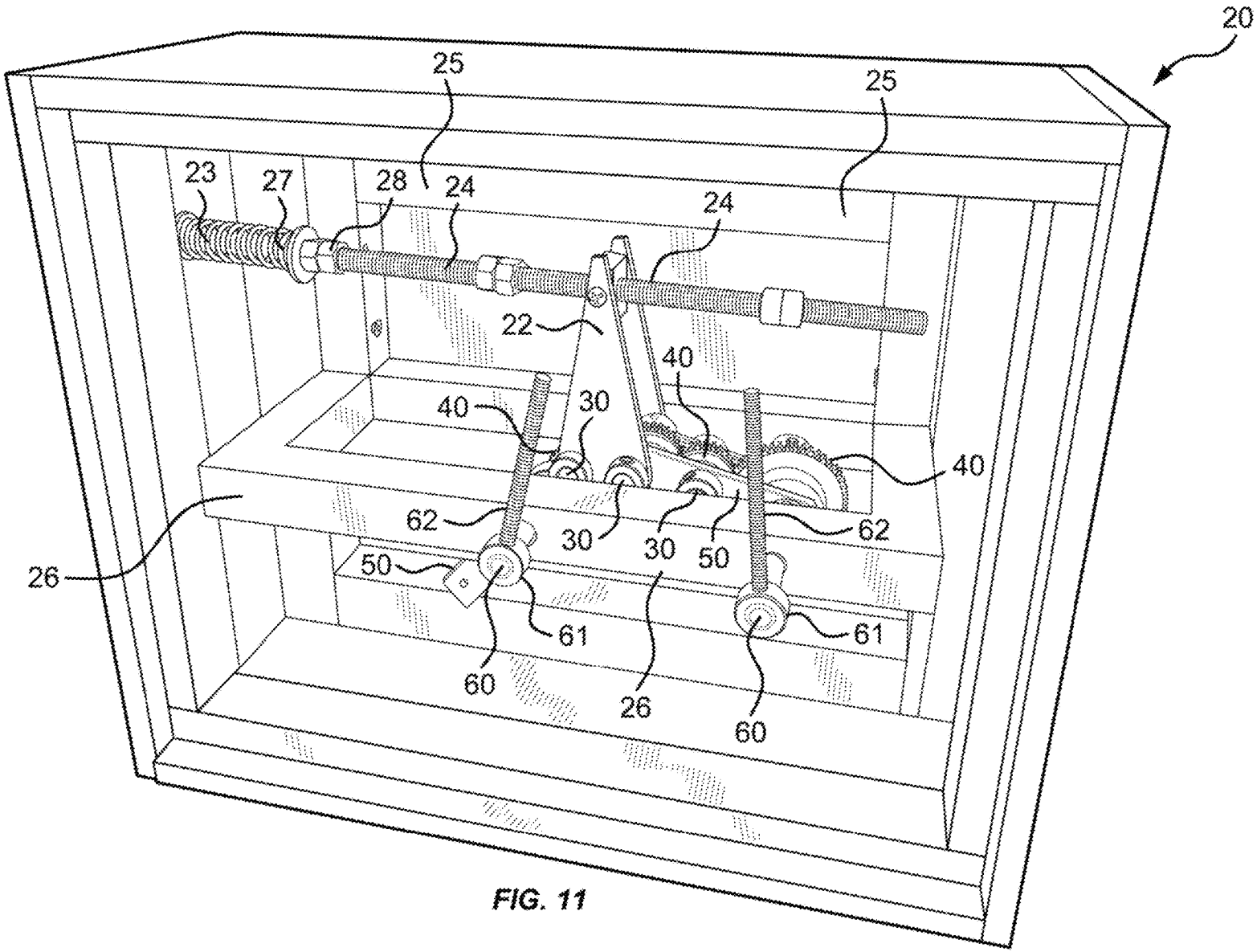
FIG. 11 is a perspective view of 2 drivers, a lever, 2 anchors, 4 gears, 3 links and 4 shafts, and 2 timing members in a second position, according to one embodiment of this invention.

According to some embodiments of this invention, such as shown in FIGS. 8-11, driver 23 and/or driver 65 can be used to drive any one or more gears 40 which can move, for example at the same speed or at different speeds, one or more timing members 62. In some embodiments of this invention, such as shown in FIGS. 8-11, driver 23 and/or driver 65 can be used to drive and/or move timing member 62 at the same rotational speed of timing member 62 with respect to the rotational speed of rotating shaft 60. According to other embodiments of this invention, such as shown in FIGS. 8-11, driver 23 and/or driver 65 can be used to drive and/or move timing member 62 at a different rotational speed of timing member 62 with respect to the rotational speed of rotating shaft 60. In some embodiments of this invention, such as shown in FIGS. 8 and 11, driver 23 and/or driver 65 can be used to drive both timing members 62 at the same driven speed and/or at different driven speeds, for example, depending upon the requirements of any engine of device 20. According to some embodiments of this invention, driver 23, driver 65, timing member 62, collar 61 and/or rotating shaft 60 can be designed or engineered to dynamically change the timing and/or phasing of the engine.

In some embodiments of this invention, it is possible to design away from the optimal and/or peak efficiency of the engine while either approaching or surpassing the chosen or selected optimal and/or peak efficiency, such as at that designed particular RPM. According to some embodiments of this invention, the optimal and/or peak efficiency can be designed as the chosen RPM and/or the ideal RPM, for example, to obtain a particular peak engine efficiency.

According to some embodiments of this invention, technically designing for a single ideal, optimal and/or peak efficiency at a particular RPM relates to or means, in mechanical technology, that a design compromise must be made. One compromise made is that this single ideal, optimal and/or peak efficiency is designed for the general public, which can relate to forming a greatest good for the greatest number of the public, but which also means that some of the public will not be satisfied with the engineering design point result. In some embodiments of this invention, due to the nature of mechanical tolerances, even this single ideal, optimal and/or peak efficiency is chosen to be the single ideal, optimal and/or peak efficiency and cannot be selected to satisfy all public members concerns.

In some embodiments of this invention, the sum of the mechanical variations in assembled pieces of this invention sometimes wanders a bit and ends up deviating or being different from the intended design. According to some embodiments of this invention, the design and/or engineering objective is to remove the constraint of a single optimal speed and thus make it possible to engineer or design the engine to achieve peak efficiency at any and every RPM, not just one single ideal, optimal and/or peak efficiency. In some embodiments of this invention, it is possible to engineer or design the single ideal, optimal and/or peak efficiency to occur at any RPM.

In some embodiments of this invention, there is a single engineering or design solution available for this engineering feat which can be elegant and simple to accomplish. According to some embodiments of this invention, the design is easily scalable upwards and/or downwards, for example, to work with or be easily adopted to and thus work with any engine size. In some embodiments of this invention, the mechanical engineering necessary to incorporate device 20 to any engine design is strictly minimal compared to many other known or conventional methods in use.

According to some embodiments of this invention, such as shown in FIGS. 1-5 and 8-11, one solution is provided through a simple or straightforward use with lever 22, screw 24 and gears 40, which makes the entire design of device 20 both simple and classic. In some embodiments of this invention, the mechanics of only using lever 22, screw 24 and gears 40, makes it easy to scale up and/or down, for example, to achieve or sustain the mechanical requirements of any size engine. In some embodiments of this invention, the geometry of this assemblage can possibly be constrained within the areas now occupied by existing timing belts and chains, for example, on conventional automotive engines.

According to some embodiments of this invention, one object of device 20 provides a dynamic controlled timing offset between two rotating shafts 60, for example, such as shown in FIGS. 8 and 11. Because there are no size restrictions, according to this invention, it is possible for device 20 of this invention to be fully scalable both upwards and/or downwards.

According to some embodiments of this invention, for example such as shown in FIGS. 1-5 and 8-11, device 20 comprises a simple arrangement of lever 22, screw 24 and gears 40, which makes it easy to scale this invention to the mechanical requirements of any size and/or type of engine. In some embodiments of this invention, the engine can be the engine of a racecar, for example, that can receive significant power efficiency benefits from incorporating device 20 that can change mechanical efficiencies at different RPMs and/or rotational speeds of the engine.

According to some embodiments of this invention, for example also shown in FIGS. 1-5 and 8-11, one simple and/or basic device 20 comprises or includes two shafts 30 and four gears 40 in a series arrangement or position where the two outer or end gears 40 are secured, stationary and/or firmly mounted to machine frame 25, such as shown in FIGS. 8 and 11. The two middle or central gears 40 are positioned, maintain and/or otherwise held connected to stationary gears 40 and each other, for example, by a set of three floating links 50. In some embodiments of this invention, one restriction to a geometry and/or layout of device 20 and/or this system is that the three links 50 are not linear and/or do not form a straight line. In some embodiments of this invention, when gears 40 rotate and/or turn, the floating links 50 tend to and/or will want or try to rearrange links 50 in such a manner as to follow the rotation of a driven and/or driving gear 40. According to some embodiments of this invention, if rotation of the driving gear 40 is reversed then the three floating links 50 and two gears 40, which are held in place by the floating links 50, will rearrange themselves or links 50 to follow the driving gear 40. In some embodiments of this invention, during this rearranging motion, the driving gear 40 will rotate and the driven gear 40 will remain stationary. According to some embodiments of this invention, eventually the driven gear 40 will rotate in a reverse direction and the net effect is to create a time lag between the driving gear 40 and the driven gear 40.

According to some embodiments of this invention, by preventing any one of the three links 50 from changing its angular position, neither of the other two links 50 will be able to change their angular position and will remain in a stable angular position.

Figure 1:
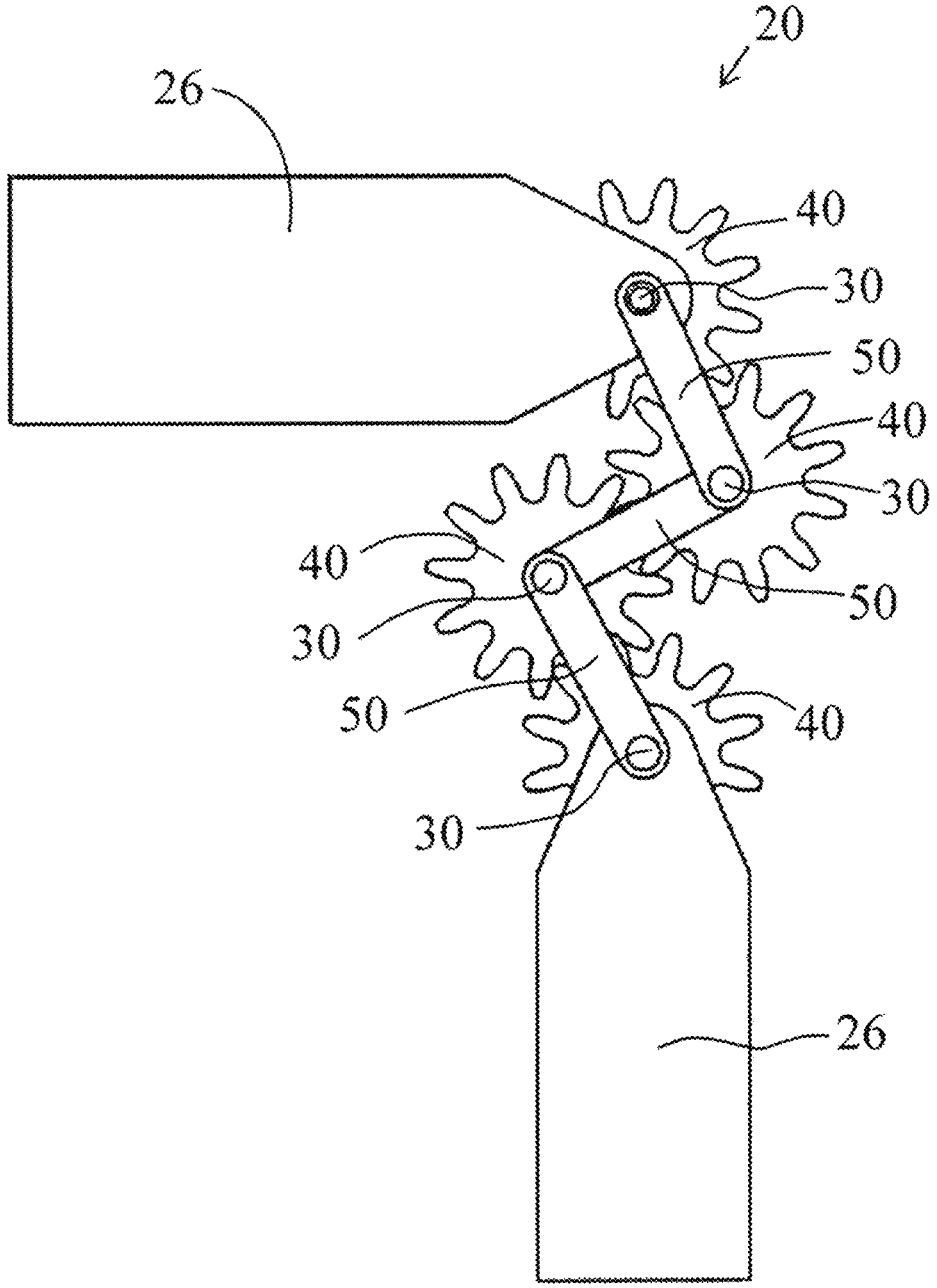
FIG. 1 is a diagrammatic view of 2 anchors, 4 gears, 3 links and 4 shafts, according to one embodiment of this invention.
Figure 2:
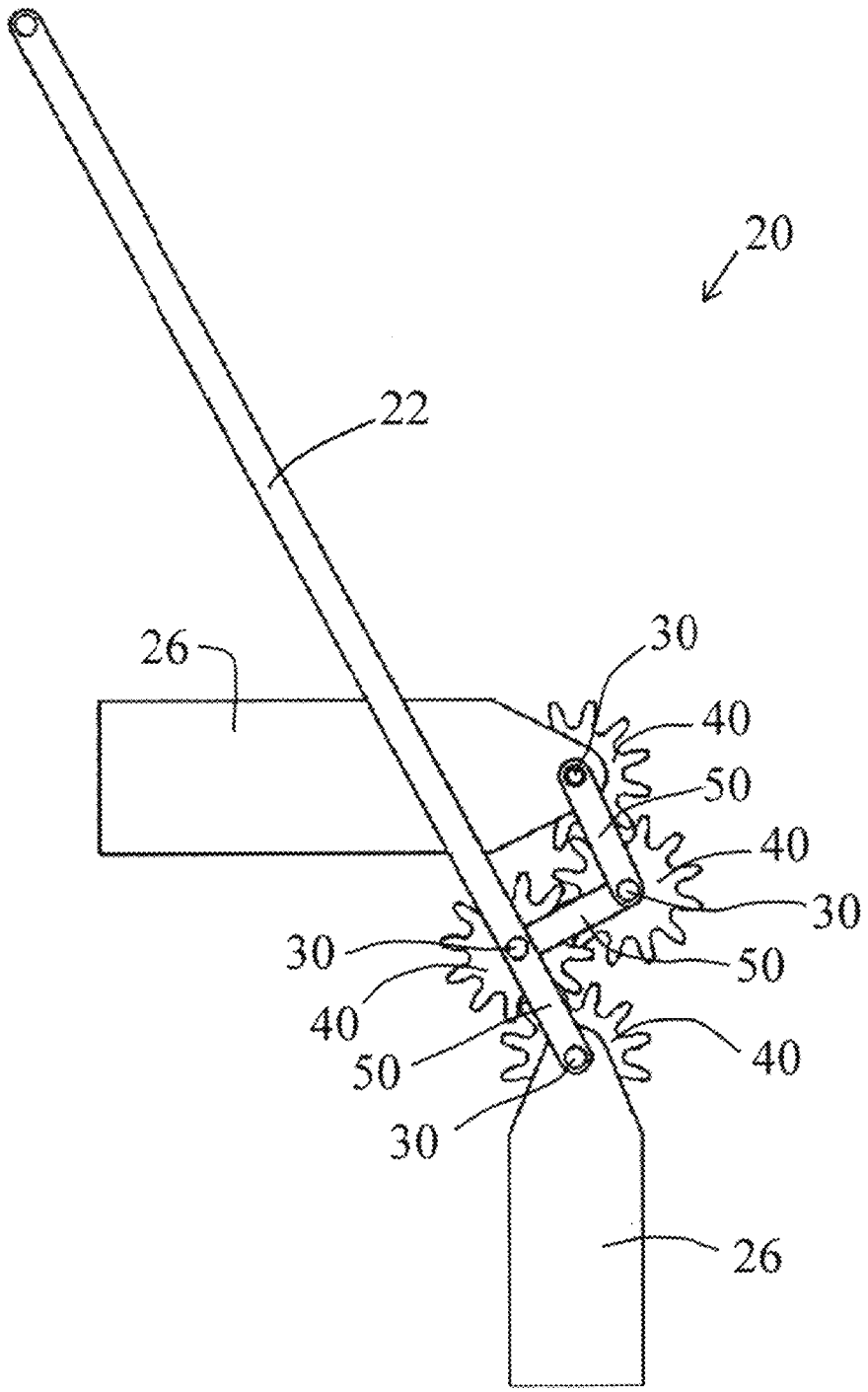
FIG. 2 is a diagrammatic view of a lever, 2 anchors, 4 gears, 3 links and 4 shafts, according to one embodiment of this invention.
Figure 3:
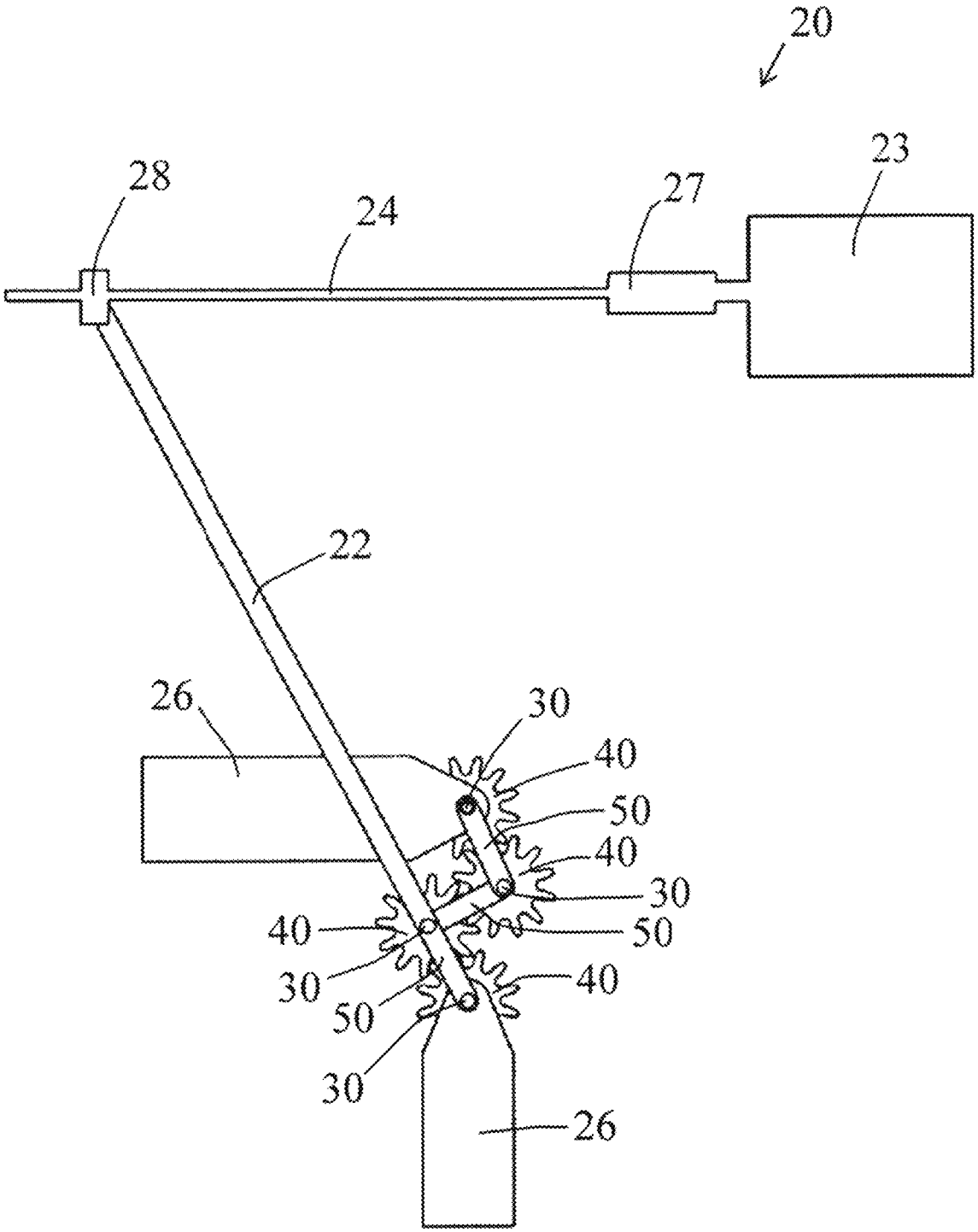
FIG. 3 is a diagrammatic view of a driver, 2 anchors, 4 gears, 3 links and 4 shafts, according to one embodiment of this invention.
Figure 4:
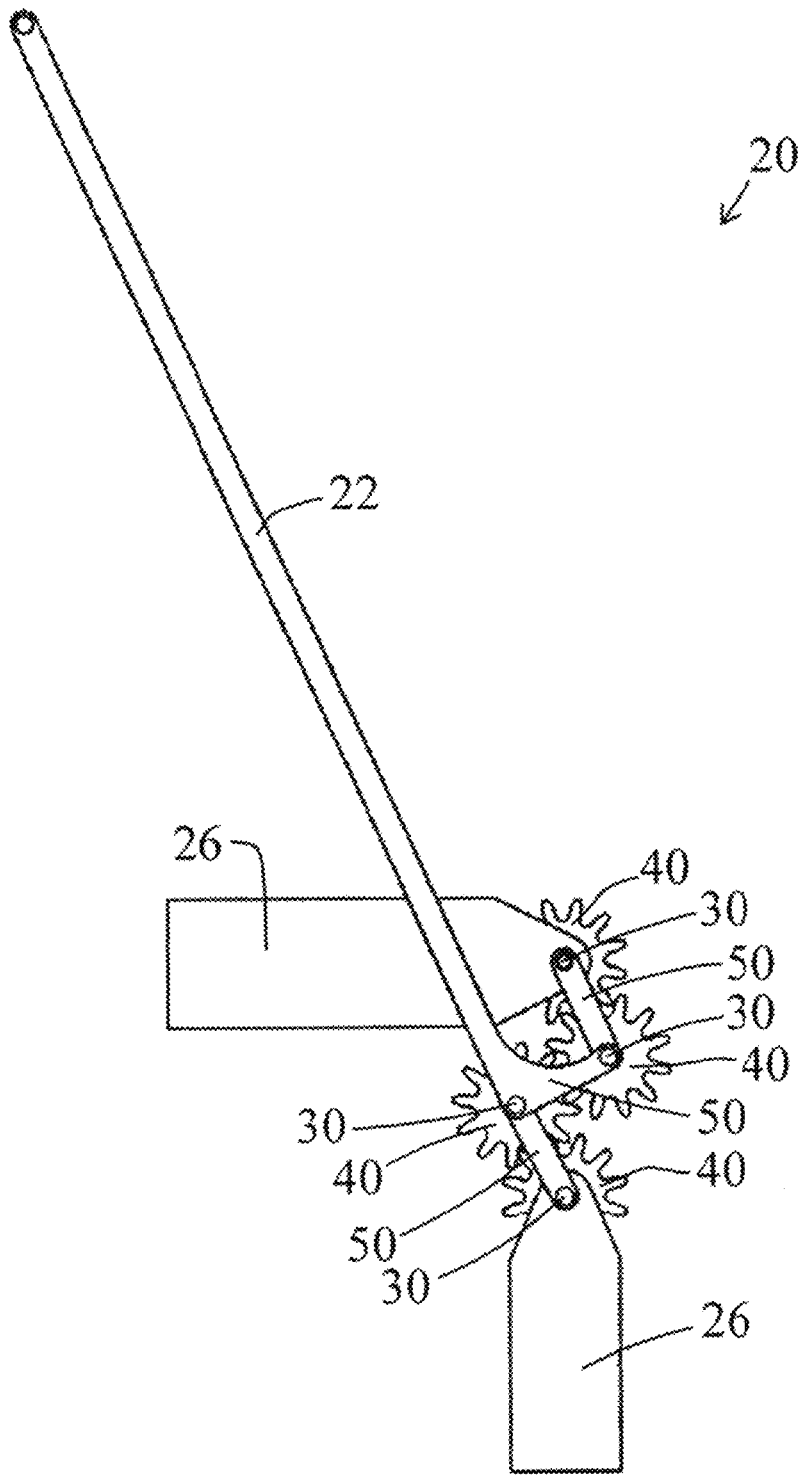
FIG. 4 is a diagrammatic view of a lever, 2 anchors, 4 gears, 3 links and 4 shafts, according to one embodiment of this invention.
Figure 5:
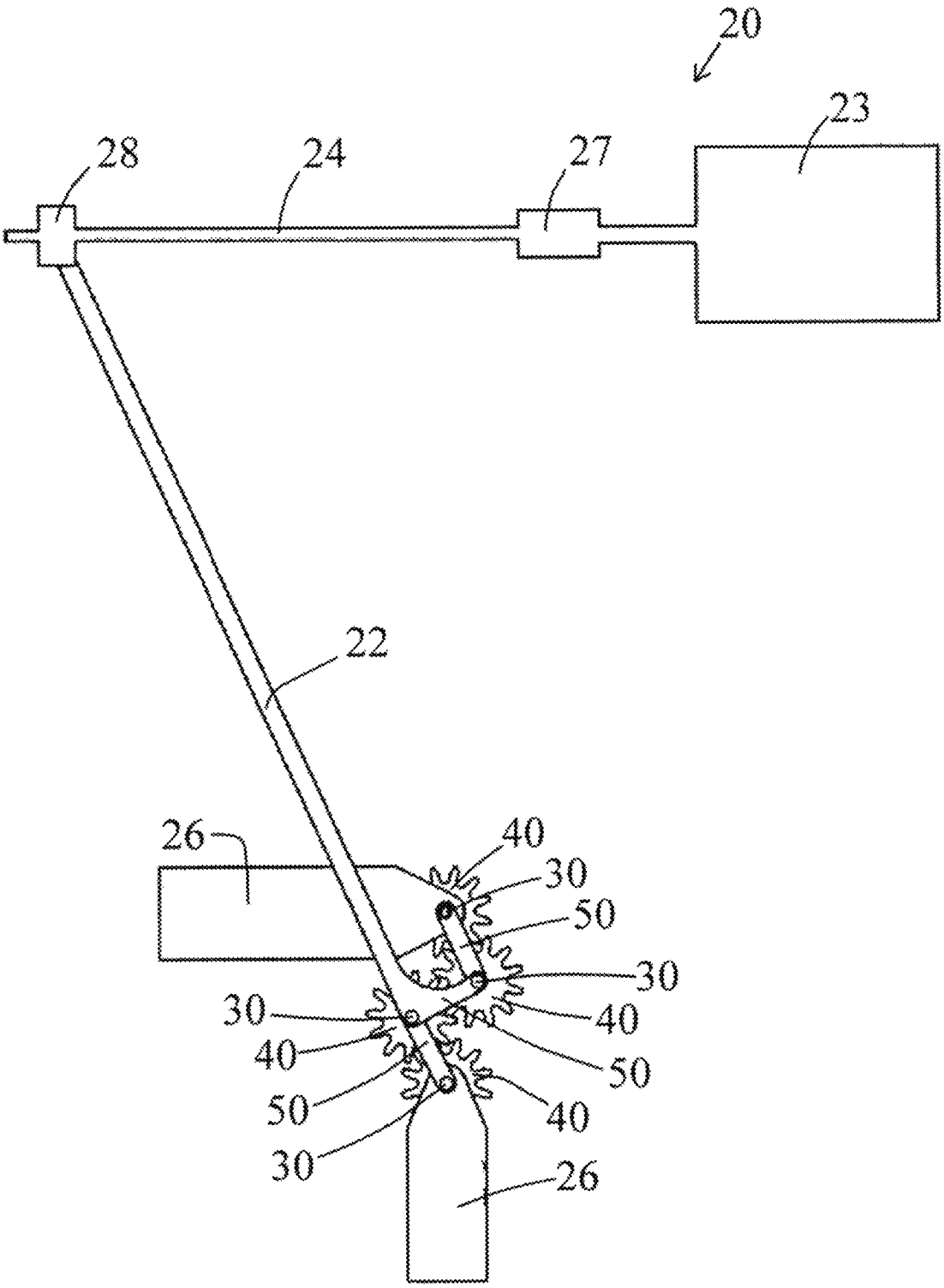
FIG. 5 is a diagrammatic view of a driver, 2 anchors, 4 gears, 3 links and 4 shafts, according to one embodiment of this invention.

According to some embodiments of this invention, for example such as shown in FIG. 2, if any one of the links 50 is extended a distance from the set of gear 40, for example, to form a lever and is anchored, for example by anchor 26 such as shown in FIGS. 8 and 11, to prevent it from rotating then the other two links 50 will remain stationary or not be able to move and if gears 40 then reverse there will be no lag for lag time at any reversal instance or occurrence. In some embodiments of this invention, if the position of this anchorage is moved, for example a relatively small amount or a little bit, then the other links 50 will reposition themselves to accommodate this movement. In some embodiments of this invention, this repositioning will result in or cause a piece of timing lag or timing lead, for example, when the three floating links 50 are not restricted, being added or subtracted for the timing between the driving gear 40 and the driven gear 40.

According to some embodiments of this invention, for example such as shown in FIGS. 4, 5, 8 and 11, one problem is that to vary a position of the anchorage in a controlled way, for example, such as with using screw 24 mechanically and/or electromechanically cooperating with driver 23, such as shown in FIGS. 3 and 8-11. In some embodiments of this invention, driver 23 can be any suitable servo motor, stepping motor and/or any other suitable driver that can be mechanically and/or electromechanically connected to and drive screw 24. In some embodiments of this invention, driver 23 can be a relatively small sized motor to drive screw 24. In some embodiments of this invention, driver 23 comprises or includes a position sensor and/or a suitable controlling unit, such as a microcontroller that communicates with and/or senses a position of one or more of gears 40.

According to some embodiments of this invention, for example as shown in FIGS. 3, 5, 8 and 11, an end of screw 24 is attached to lever 22 which can be an arm and/or extension of one of the three links 50, for example, using coupling 28 as a connector between screw 24 and lever 22. In some embodiments of this invention, coupling 28 can be a nut, such as a swivel nut and/or any other suitable structure that allows a connection, particularly a rotatable connection, between screw 24 and lever 22.

In some embodiments of this invention, such as shown in FIGS. 3, 5, 8 and 11, a nut freely rotates on the arm and the other end of screw 24 is attached to a suitable drive mechanism, such as driver 23. In some embodiments of this invention, as the end of this extended link 50 travels in an arc and/or any other suitable direction or path, for example, to mount the driver 23 and/or any other suitable drive mechanism on a flexible arm or connect to screw 24 with a short piece of flexible shaft 27 and/or any other suitable device that accomplishes the same result of a flexible connection.

In some embodiments of this invention, a free end of the lever can also be extended radially from gears 40 and/or a gear profile can be placed on it and driven by another suitable gear 40.

According to some embodiments of this invention, for example, such as shown in FIGS. 3, 5, 8 and 11, any suitable mechanical and/or electromechanical sensor can be used and/or installed in connection with screw 24, driver 23 and/or any other suitable screw drive motor, to determine a position of the corresponding element of this invention. In some embodiments of this invention, a position sensor on lever 22 is used to determine a position of lever 22 and/or any other different elements of this invention, for example, to provide feedback and/or a feedback signal to a computer program. In some embodiments of this invention, the computer program and/or the sensors can be used to control driver 23 and/or any other suitable screw drive mechanism, for example, to dynamically turn screw 24, for example, to rotate lever 22 such as to achieve perfect timing for device 20.

In some embodiments of this invention, such as shown in FIGS. 3, 5, 8 and 11, driver 23 and/or 65 has a readable memory device and/or processor mounted within and/or otherwise positioned in driver 23 and/or 65. In some embodiments of this invention, also such as shown in FIGS. 3, 5, 8 and 11, another suitable housing or element of this invention has a readable memory device and/or processor mounted within and/or otherwise positioned in that particular housing. According to some embodiments of this invention, the processor communicates with the readable memory device and/or any other suitable digital memory device, such as any suitable 16-bit chip, 64-bit chip, 128-bit chip, 256-bit chip, 512-bit chip and/or any other suitable size chip and/or chips that can hold memory, such as digital memory and/or computer memory. In some embodiments of this invention, the processor comprises any suitable central processing unit (CPU) and/or micro controller unit (MCU) device and/or other suitable computing device that can be purchased from any known suitable manufacture. In some embodiments of this invention, the processor is positioned within, housed within and/or a part of the suitable and corresponding housing of this invention.

According to some embodiments of this invention, the processor is electrically connected to and/or otherwise in a suitable manner electrically communicates, for example, with a suitable wired connection and/or a suitable wireless connection, with the readable memory device. In some embodiments of this invention, the readable memory device includes content and/or stored information, for example, specifically related to the timing and/or phasing needs of this invention. In some embodiments of this invention, the processor and the readable memory device are both positioned and/or housed within any suitable housing.

In some embodiments of this invention, using screw 24 and the corresponding extended link, which forms lever 22, the torque needed to drive the driven gear 40 will be greatly reduced. According to some embodiments of this invention, the torque required to turn screw 24 can be supplied with a relatively small driver 23 and/or a relatively small motor. According to some embodiments of this invention, a position sensor is necessary to monitor a geometry and/or physical arrangement of the system, for example, so that a simple logic circuit is all that is needed to drive the servo or stepping motor to set the timing offset to a predetermined amount, for example, according to a speed of the driving gear.

According to some embodiments of this invention, they are all held in place by three links 50 arranged in and/or on a same plane. In some embodiments of this invention, one purpose of the links 50 is to hold gears 40 constantly engaged and to maintain a geometry of physical relationships between gears 40. In some embodiments of this invention, the two shafts 30 are required to not have any lateral or axial movement and need to only rotate. According to some embodiments of this invention, each shaft 30 also has one gear 40 and one end of link 50, and in other embodiments, the other ends of links 50 extending from shafts 30 connect to additional shafts 30 on the center link 50. The middle of the three links 50, sometimes called the center link 50, has one gear 40 mounted at each end. In some embodiments of this invention, each center link gear 40 will engage gear 40 on shaft 30 which is adjacent to it.

According to some embodiments, the sums of the pitch diameters of the two gears 40 on the center link 50 have to be greater than the distance between the pitch diameters of gears 40 on shafts 30. In some embodiments of this invention, this formula for pitch diameters dictates that links 40 and gears 50 assume a non-linear position remaining on the same plane. In some embodiments of this invention, when gears 40 assume different positions the center link 50 must move and moving the center link 50 will corresponding move gears 40, and as this movement takes place the timing of gears 40 on shafts 30 can vary. In some embodiments of this invention, because gears 40 and shafts 30 are mechanically linked, the timing will vary as the timing of gears 40 on shafts 30 varies.

In other embodiments of this invention, the nature of this geometric configuration will dictate a non-linear variation of the timing change with respect to a center link 50 position and also different link 50 positions can provide different levels of timing adjustments.

In some embodiments of this invention, the timing can be an issue, for example, when providing different levels of timing adjustments. According to some embodiments of this invention, as device 20 moves through different link 50 positions, device 20 will provide different levels of timing adjustments. In some embodiments of this invention, device 20 is referred to as a dynamic timing adjuster which can have one advantage of the geometry previously described.

According to some embodiments of this invention, links 50 move through all possible positions and establish a path and the timing and/or phasing between the shafts will change at different rates along this path. By restricting the link positions about an area where this rate is high will produce a large amount of timing and/or phase adjustment. In some embodiments of this invention, anchoring links 50 at any point along the path will force the timing between shafts 30 to remain the same, unchanged and/or locked-in and thus can cause the entire assembly to be rigid and/or stiff. In some embodiments of this invention, changing the position of where links 50 are anchored will force the shafts to change their timing and/or phase. In some embodiments of this invention, these changes can be made dynamically which will result in dynamically changing the timing and/or phasing. According to some embodiments of this invention, when the anchorage is moved dynamically along the path, the dynamic timing adjuster can dynamically change the timing between shafts 30.

Figure 6:
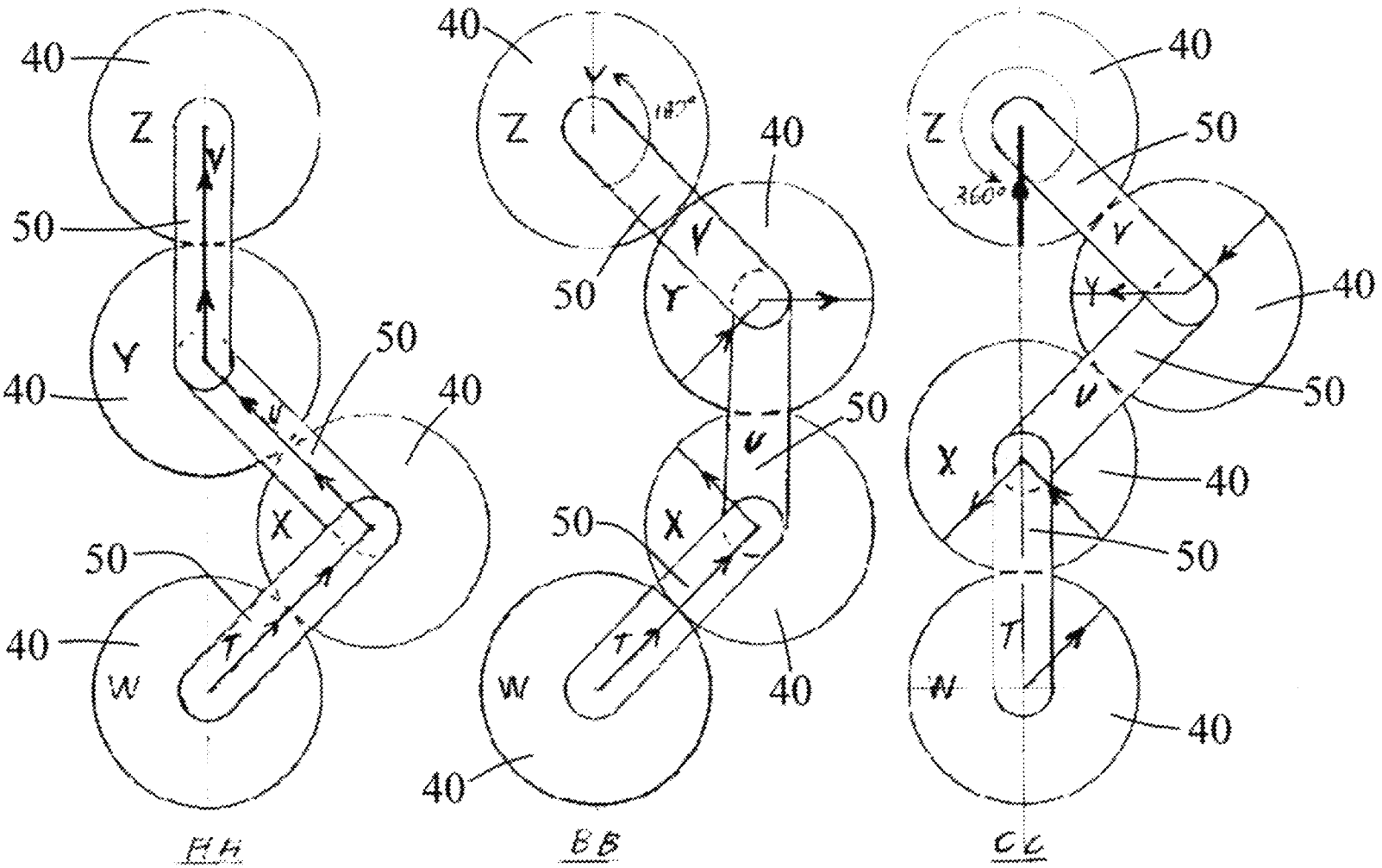
FIG. 6 is a diagrammatic view of 3 different layout positions or arrangements of 4 gears, 3 links and 4 shafts, according to one embodiment of this invention.
Figure 7:
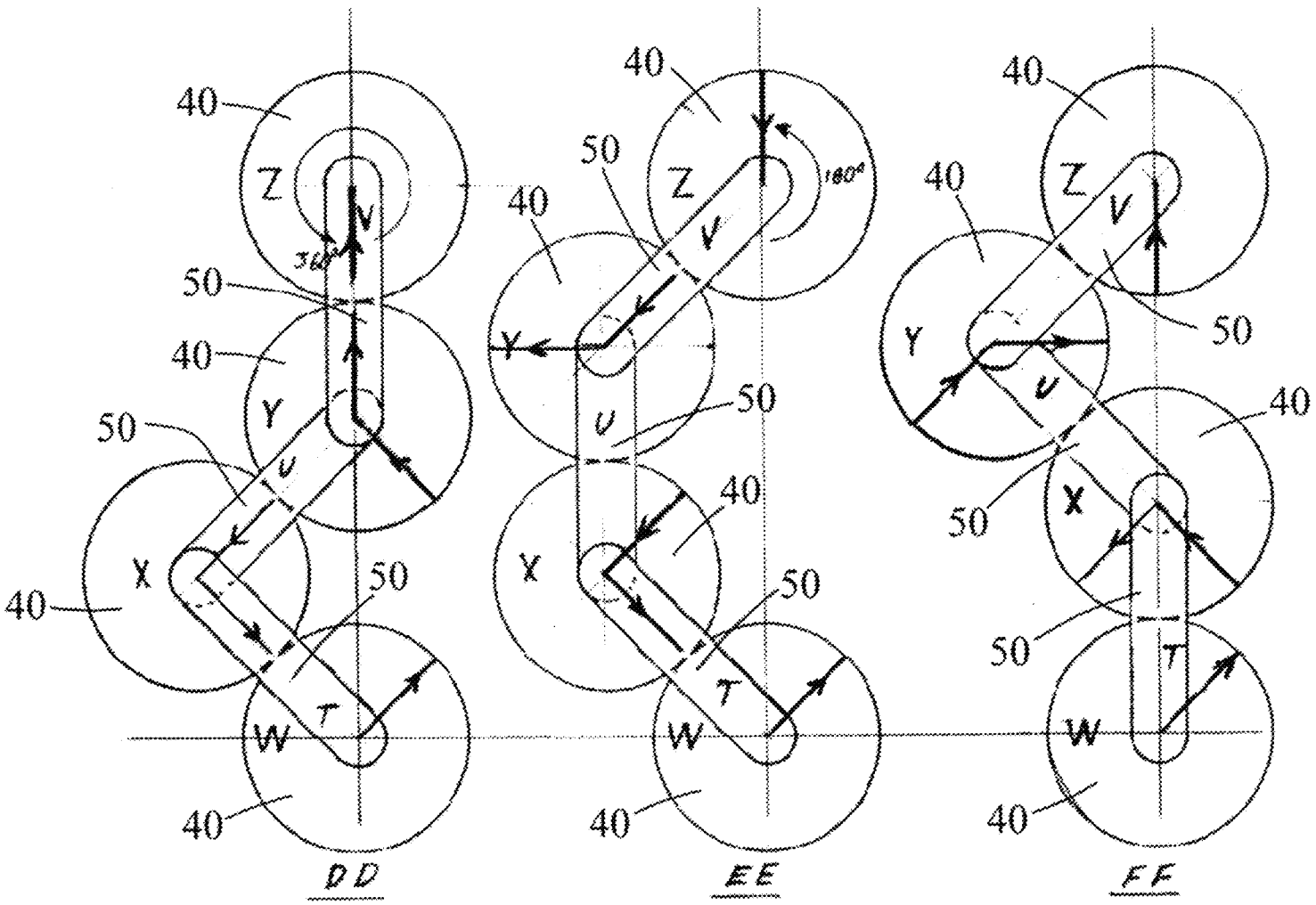
FIG. 7 is a diagrammatic view of 3 different layout positions or arrangements of 4 gears, 3 links and 4 shafts, according to one embodiment of this invention.

FIGS. 6 and 7 show different embodiments of operation schematics according to this invention. FIGS. 6 and 7 show 6 diagrams which are assembly schematics of three links 50 and four gears 40 which make up or comprise a 3-link timing adjusting device, according to different embodiments of this invention. Both FIGS. 6 and 7 show a relationship between links 50 and gears 40, for example, in a series configuration and/or a sequential configuration. FIG. 6 shows a diagram containing labels AA, BB and CC. FIG. 7 shows a diagram containing labels DD, EE and FF. In FIGS. 6 and 7, gears 40 are labeled W, X, Y and Z, and links 50 are labeled T, U and V. In FIGS. 6 and 7, the arrows on gears 40 indicate the timing of gears 40 and in some embodiments according to this invention, there is initial power transmission from gears W through and to Z. According to some embodiments of this invention, on gear Z there is also indicated and/or shown the timing offset from reference detail AA. In some embodiments of this invention, gears W and Z are mounted on fixed rotating shafts 30. According to some embodiments of this invention, the center link 50 is shown as or indicated by U.

According to some embodiments of this invention, the six diagrams of FIGS. 6 and 7 show or demonstrate how the timing offset is accomplished in response to link 50 position. In some embodiments of this invention, starting with diagram or detail reference AA, gear Y is moving to its new position in diagram or detail reference BB. According to some embodiments of this invention, as this happens or occurs, gear X must move to allow for gear Y to pass and then gear X will return to its prior position. In some embodiments of this invention, the final gear positioning is indicated in or shown as BB and the offset to the timing of gear Z is now 180° counterclockwise. According to some embodiments of this invention, the additional diagrams of FIGS. 6 and 7 show different gear 40 positions and different timing offsets to gear Z.

According to some embodiments of this invention, FIGS. 6 and 7 show a sequence of this invention in diagrams or detail references AA, BB, CC, DD, EE and FF, including shown that the lower gear W is fixed and by moving links 50 to shift the position of gears 40 on the center link 50, it is possible to modify the timing and/or phase between the top gear Z and the bottom gear W.

According to some embodiments of this invention, such as shown in FIGS. 6 and 7, a sequence of using diagram or detail reference AA as a reference is presented in this specification. In some embodiments of this invention, this sequence demonstrates how the timing offset of gear Z is affected as the center link gears 40 are relocated through a sequence of six positions shown in diagrams or detail references AA through FF.

In some embodiments of this invention, as shown FIGS. 6 and 7, relocating or positioning link U clockwise 45° will also rotate link V 45° counterclockwise and it will also relocate gear Y as shown in diagram or detail reference BB and the top gear Z will shift its timing by 180° counterclockwise.

In some embodiments of this invention, as shown FIGS. 6 and 7, relocating link U another 45° clockwise, link T will rotate 45° counterclockwise, gear X will relocate as shown in diagram or reference detail CC and gear Z will shift its timing an additional 180° counterclockwise, bringing the total timing shift to 360° counterclockwise.

In some embodiments of this invention, as shown FIGS. 6 and 7, when the link T is relocated counterclockwise 45°, link V will rotate 45° clockwise and gears X and Y will be relocated as shown in diagram or reference detail DD. According to some embodiments of this invention, this change shown in diagram or reference detail CC to DD there will be no overall change in timing although some minor timing variations will occur but the sum total timing changes will be zero.

In some embodiments of this invention, as shown FIGS. 6 and 7, relocating link U counterclockwise 45° and link V 45° clockwise, gear Y will relocate as shown in diagram or reference detail EE. According to some embodiments of this invention, the change in the offset timing for gear Z will be reduced to 180° counterclockwise.

In some embodiments of this invention, as shown FIGS. 6 and 7, relocating link T clockwise 45° will move link U 45° counterclockwise. According to some embodiments of this invention, now gear X will be relocated as shown in diagram or reference detail FF and the timing offset of gear Z will be reduced to zero.

In some embodiments of this invention, as shown FIGS. 6 and 7, when link V is relocated 45° counterclockwise and link T rotates 45° clockwise and gears X and Y are relocated to diagram or reference detail AA, which is the starting position. According to some embodiments of this invention, there is no change in timing although some minor timing variations will occur but the sum total will be zero.

While in the foregoing detailed description this invention has been described in relation to certain embodiments, and many details have been set forth for purposes of illustration, it will be apparent to those skilled in the art that this invention is susceptible to additional embodiments and that certain of the details described herein can be varied considerably without departing from the basic principles of and desired results from this invention.

The invention claimed is:

1. A timing adjuster device comprising:

a driver, an anchor fixedly mounted with respect to a frame;

a first gear, a second gear, a third gear and a fourth gear;

a first link, a second link and a third link;

a first shaft, a second shaft, a third shaft and a fourth shaft;

the first shaft and the fourth shaft fixed with respect to the anchor, the second shaft and the third shaft movably mounted with respect to the anchor;

a first end portion of the first link rotatably mounted about the first shaft, a second end portion of the fourth link rotatably mounted about the fourth shaft;

a second end portion of the first link movably mounted with respect to the anchor, a first end portion of the fourth link movably mounted with respect to the anchor;

the second link movably mounted with respect to the anchor;

the first gear rotatably mounted with respect to the anchor, the fourth gear rotatably mounted with respect to the anchor;

the second gear rotatably mounted about the second shaft, the third gear rotatably mounted about the third shaft; and the driver driving at least one of the first link, the second link, and the third link, and the driver driving a timing member.

2. The timing adjuster device according to claim 1, wherein anchoring the links at any point along a path will force a timing between the shafts to remain unchanged resulting in an entire assembly being rigid, changing a position of where the links are anchored forces the shafts to change a timing and/or phasing, the changes are made dynamically resulting in dynamically changing the timing and/or phasing, and moving the anchor dynamically along the path dynamically changes the timing and/or phasing between the shafts.

3. The timing adjuster device according to claim 1, wherein the driver is connected to and drives any one or more of the first link, the second link, and the third link to move the timing member.

4. The timing adjuster device according to claim 1, wherein at least one of the driver, a second driver connected to a rotating shaft, the timing member, a collar connected to the rotating shaft and the rotating shaft operates to dynamically change a timing and/or a phasing of an engine of the device.

5. The timing adjuster device according to claim 1, wherein a second driver is connected to and drives any one or more of the first gear, the second gear, the third gear and the fourth gear to move the timing member.

6. The timing adjuster device according to claim 1, wherein the links move through all possible link positions and establish a path and a timing or phasing between rotating shafts of the device changes at different rates along the path, and restricting the link positions about a relatively high rate area produces a relatively large amount of timing or phasing adjustment.

7. The timing adjuster device according to claim 6, wherein anchoring the links at any point along the path will force the timing or phasing between the shafts to remain unchanged and/or locked in and will make the entire assembly rigid, or changing a position of where the links are anchored forces the shafts to change their timing or phasing and changes are made which will result in changing the timing or phasing.

8. The timing adjuster device according to claim 1, wherein moving any one of the three links and rotating a driven gear of the gears creates a time offset between a driving gear of the gears and the driven gear.

9. The timing adjuster device according to claim 1, wherein as the device moves through different link positions of the links, the device provides different levels of timing adjustments and the device is a timing adjuster with a geometry of a path.

10. The timing adjuster device according to claim 1, wherein the links move through all possible positions and establish a path and the timing and/or the phasing between the rotating shafts changes at different rates along the path, by restricting link positions about an area where a rate is high and produces a large amount of timing and/or phase adjustment.

11. A timing adjuster device comprising:

a driver, an anchor fixed with respect to a frame;

a first gear, a second gear, a third gear and a fourth gear;

a first link, a second link and a third link;

a first shaft, a second shaft, a third shaft and a fourth shaft;

the first shaft and the fourth shaft fixed with respect to the anchor, the second shaft and the third shaft movably mounted with respect to the anchor; and the driver connected to and driving any one or more of the first link, the second link, and the third link to move a timing member.

12. The timing adjuster device according to claim 11, wherein a second driver is connected to and drives any one or more of the first link, the second link, and the third link to move the timing member.

13. The timing adjuster device according to claim 11, wherein at least one of the driver, a second driver connected to a rotating shaft, the timing member, a collar connected to the rotating shaft and the rotating shaft operates to dynamically change a timing and/or a phasing of an engine of the device.

14. The timing adjuster device according to claim 11, wherein the links move through all possible link positions and establish a path and a timing or phasing between rotating shafts of the device changes at different rates along the path, and restricting the link positions about a relatively high rate area produces a relatively large amount of timing or phasing adjustment.

15. The timing adjuster device according to claim 11, wherein as the device moves through different link positions of the links, the device provides different levels of timing adjustments and the device is a timing adjuster with a geometry of a path.

16. A method for operating a timing adjuster, including the steps of:

fixing an anchor with respect to a frame;

forming a first gear, a second gear, a third gear and a fourth gear;

forming a first link, a second link and a third link;

forming a first shaft, a second shaft, a third shaft and a fourth shaft;

fixing the first shaft and the fourth shaft with respect to the anchor;

movably mounting the second shaft and the third shaft with respect to the anchor; and driving at least one of the first link, the second link, and the third link to move a timing member.

17. The method according to claim 16, wherein a timing driver is connected to and drives any one or more of the first link, the second link, and the third link to move the timing member.

18. The method according to claim 16, wherein at least one of a driver, a second driver connected to a rotating shaft, the timing member, a collar connected to the rotating shaft and the rotating shaft operates to dynamically change a timing and/or a phasing of an engine of a device.

19. The method according to claim 16, wherein the links move through all possible link positions and establish a path and a timing or phasing between rotating shafts of a device changes at different rates along the path, and restricting the link positions about a relatively high rate area produces a relatively large amount of timing or phasing adjustment.

20. The method according to claim 16, wherein as a device moves through different link positions of the links, the device provides different levels of timing adjustments and the device is a timing adjuster with a geometry of a path.

* * * * *